US005381577A

United States Patent [19]

Lilja

[11] Patent Number: 5,381,577

[45] Date of Patent: Jan. 17, 1995

[54] MEANS FOR CONNECTING A UNIT FOR TREATING FLOOR SURFACES WITH A ROD LIKE MEMBER INTENDED FOR GUIDING SAID UNIT

[76] Inventor: Bo V. Lilja, Lorensviksvägen 14, 183 63 Täby, Sweden

[21] Appl. No.: 979,856

[22] PCT Filed: Sep. 3, 1991

[86] PCT No.: PCT/SE91/00574

§ 371 Date: Feb. 25, 1993

§ 102(e) Date: Feb. 25, 1993

[87] PCT Pub. No.: WO92/03962

PCT Pub. Date: Mar. 19, 1992

[30] Foreign Application Priority Data

Sep. 6, 1990 [SE] Sweden ..... 90 02842-4

[51] Int. Cl.[6] ..... A47L 11/40

[52] U.S. Cl. ..... 15/49.1; 15/98; 15/144.2; 15/410; 403/57; 403/74; 451/353

[58] Field of Search ..... 15/49.1, 50.1, 52, 98, 15/144.2, 361, 410, 411; 16/111 A, 112; 51/174, 177; 280/47.131, 47.24; 403/57-59, 74

[56] References Cited

U.S. PATENT DOCUMENTS

| | | | |
|---|---|---|---|
| 432,130 | 7/1890 | Fenton | 403/57 |
| 773,436 | 10/1904 | Tangerman | 15/49.1 |
| 1,224,292 | 5/1917 | Fisker | 15/410 |
| 1,401,400 | 12/1921 | Green . | |
| 1,687,953 | 10/1928 | Starks | 403/58 |
| 2,034,455 | 3/1936 | Baird | 15/98 |
| 2,038,697 | 4/1936 | Winslow | 403/57 |
| 2,432,098 | 12/1947 | Horn | 15/144.2 |
| 2,655,413 | 10/1953 | Russell | 403/58 |
| 3,013,287 | 12/1961 | Descarries | 15/410 |
| 3,203,707 | 8/1965 | Anderson | 16/111 A |
| 3,204,272 | 9/1965 | Greene et al. | 16/111 A |
| 3,310,828 | 3/1967 | Clark et al. | 15/328 |
| 3,360,286 | 12/1967 | Smyth | 403/58 |
| 3,377,639 | 4/1968 | Stevenson | 15/98 |
| 3,731,334 | 5/1973 | Carbonell | 15/144.2 |
| 4,266,317 | 5/1981 | Duda | 15/411 |
| 4,570,278 | 2/1986 | Bloome et al. | 15/98 |

FOREIGN PATENT DOCUMENTS

| | | | |
|---|---|---|---|
| 840298 | 5/1952 | Germany | 15/49.1 |
| 375311 | 6/1932 | United Kingdom | 15/98 |
| 1020776 | 2/1966 | United Kingdom | 15/49.1 |
| 1202369 | 8/1970 | United Kingdom | 15/49.1 |
| WO88/08685 | 11/1988 | WIPO . | |
| WO90/10415 | 9/1990 | WIPO . | |

*Primary Examiner*—Mark Spisich

*Attorney, Agent, or Firm*—Burns, Doane, Swecker & Mathis

[57] ABSTRACT

A coupling device for coupling a floor-treating unit to a rod-like device for guiding the floor-treating unit includes a first coupling part and a second coupling part. The first coupling part is hingedly connected to the elongated rod at a hinge axis and the second coupling part is rotatably mounted on the floor-treating unit for rotatable movement about a generally horizontal rotational axis. The first coupling part is movably positioned in a slot in the second coupling part for movement between a first positional setting in which the second coupling part is locked against rotational movement, a second positional setting in which the rod is movable about the hinge axis to unlock the second coupling part and permit rotational movement of the second coupling part about the rotational axis, and a third positional setting in which the rod is movable about the hinge axis for being lowered over the floor-treating unit in a stored position.

5 Claims, 2 Drawing Sheets

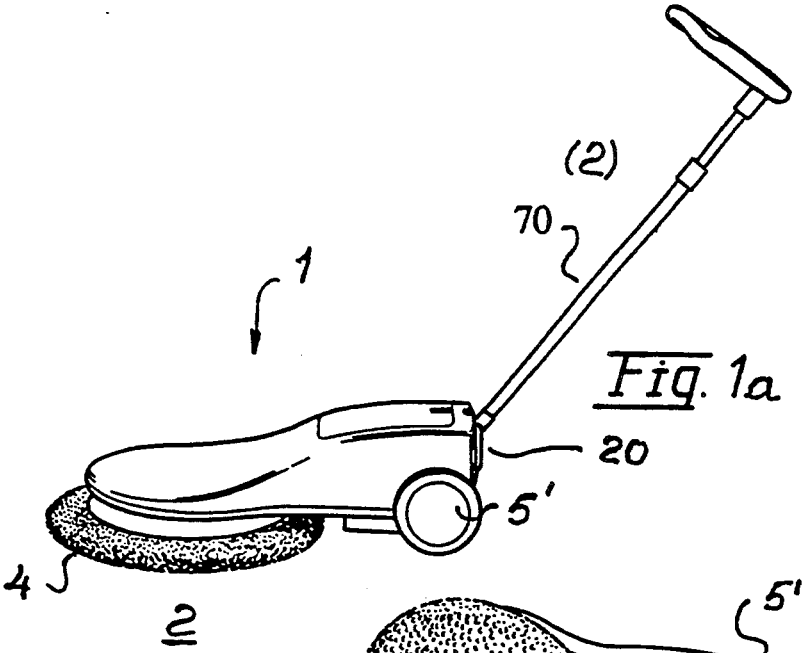
Fig. 1a
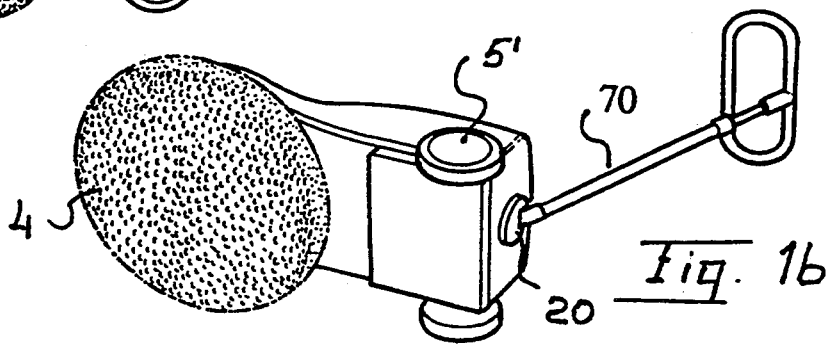
Fig. 1b
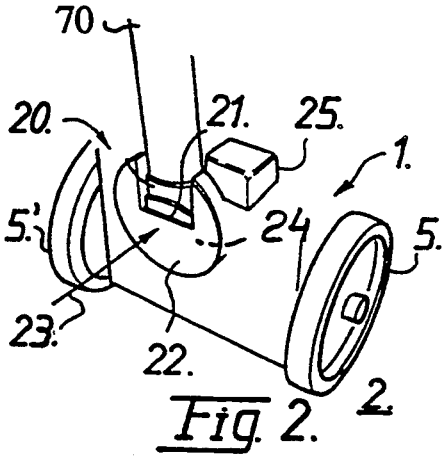
Fig. 2.
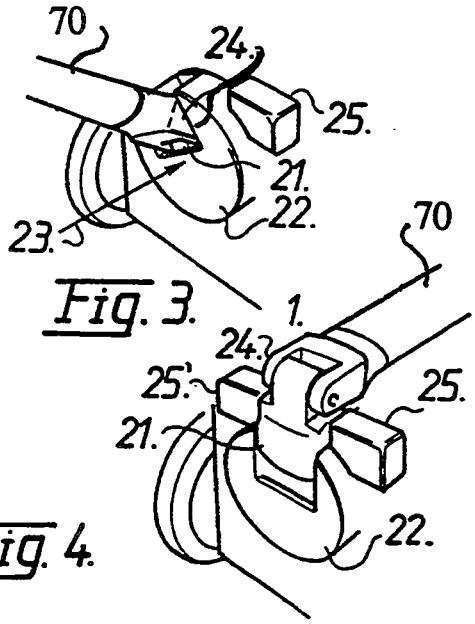
Fig. 3.
Fig. 4.

MEANS FOR CONNECTING A UNIT FOR TREATING FLOOR SURFACES WITH A ROD LIKE MEMBER INTENDED FOR GUIDING SAID UNIT

TECHNICAL FIELD

The present invention relates generally to means for mutually connecting two machine elements, and more specifically to coupling means for use with a floor-treating unit and a rod-like device intended for guiding or steering the unit.

According to the invention, the coupling means includes a first coupling part belonging to the rod-like device and a second part belonging to said unit, and that said second part is pivotally mounted on said unit such as to enable the unit to be steered over the floor.

BACKGROUND ART

The use of a rod-like device which has a handle mounted on its upper free end and by means of which a floor-treating unit is manoeuvred when wishing to move and steer said unit over a floor surface is previously known to the art, in various forms. As an example of the state of the prior art, reference is made to the teachings of U.S. Pat. No. 3,310,828 and U.S. Pat. No. 1,401,400, of which the construction disclosed in the first mentioned patent specification is thought to lie closest to the present invention. This prior publication teaches a rod-like flexible device provided with an upper handgrip which is pivotally mounted in relation to the floor-treating unit on a horizontal, bottom axle such as to enable the unit to be rotated horizontally and steered by rotating and tilting the rod-like device when moving said unit over the floor for the purpose of treating said floor.

The object of the present invention is to provide means which will enable a floor-treating unit of the kind shown in principle in FIG. 6 of the International Patent Application No. PCT/SE90/00133 to be manoeuvred in a simple fashion, although it will be understood that the invention is not limited to this application since the principle features of the invention can be applied with other units than floor-treating units.

With regard to the inventive linkage system, reference is made to the present state of the art and also to the disclosures made in the International Patent Application No. PCT/US88/01391.

DISCLOSURE OF THE INVENTION

TECHNICAL PROBLEMS

When considering the state of the prior art as described and illustrated in the aforesaid published applications, it will be seen that a technical problem, from the aspect of construction and of manoeuverability, resides in the provision of simple coupling means which afford the advantage that a first coupling part and a second coupling part which enables the unit to be manoeuvred easily over a floor surface are pivotally connected to one another via a horizontally or generally horizontally extending pivot axis which can be locked in a position which will prevent rotation in this position by vertical displacement of said parts in relation to one another, thereby to cause the rod-like device to adopt a locked position, preferably in an upward direction, which therewith facilitates rolling transport and movement of the unit over the floor surface or the like.

It will also be seen that a technical problem resides in the provision of a simple construction which is adapted to a floor-treating unit and which enables the first part of said coupling means to be moved vertically in relation to the second part of said coupling means, by applying an upwardly directed force or a downwardly directed force to the rod-like device.

It will also be seen that a technical problem resides in the provision of a coupling means which will also enable the unit and rod-like device to be adjusted to a third position or setting by relative displacement of the first coupling part in relation to the second coupling part, solely by activating the rod-like device. In this third position, the rod or the rod-like device can be rotated via a horizontal hinge means to a position in which said rod or rod-like device lies over the unit, a so-called storage position.

It will also be seen that a technical problem is one of realizing that this third position shall be the uppermost position.

It will also be seen that a technical problem resides in the provision of a construction in which the first position is the lowermost position and thereby provide conditions such that locking of said rotational movement is now effected by means of a lock-like arrangement which acts between the frame of said unit and said second coupling part or said rod.

Another technical problem is one of creating a design for the first coupling part and the second coupling part such that these parts will not only solve the aforesaid technical problems but can also be manufactured by plastic moulding methods.

SOLUTION

The present invention provides a solution to one or more of the aforesaid technical problems and is based on a floor-treating unit which is guided by means of a rod-like device, and relates to the provision of a novel means for coupling the unit to said device.

The invention has for its starting point a coupling means which includes a first coupling part which belongs to said rod-like device and a second coupling part which belongs to said unit, this second coupling part being pivotally mounted on the unit in a manner to enable the unit to be guided when moved over the floor.

In accordance with the present invention, the first coupling part is displaceable in relation to the second coupling part in a (vertical) direction between at least two different positional settings. In the first of these settings, the second coupling part is locked against rotation in relation to the unit, whereas in the second setting the lock is released so that the second coupling part is able to rotate relative to the unit about a horizontal axle, in response to tilting of the rod-like device.

In accordance with proposed embodiments which lie within the scope of the invention, the rod-like device, when moved to the first setting, extends upwardly and enables the unit to be transported and rolled on the floor.

In a third setting, the second coupling part and the rod are collapsed over the unit, through the medium of a hinge means, thereby bringing the rod and the unit to a so-called storage or stowing position.

It is also suggested that the third positional setting is the uppermost position.

It thus follows that the first setting may be the lowermost setting, in which case locking of the rotary movement between the second coupling part and the unit can be effected with the aid of a lock-like arrangement that is active between the unit frame and the second coupling part or the rod.

According to one particular embodiment of the invention, the rotational axis of the second coupling part of the coupling means extends horizontally or generally horizontally in a direction between two wheels and over or through circular plate or polishing element mounted on the unit.

ADVANTAGES

Those advantages primarily afforded by the inventive coupling means reside in the provision of conditions which will enable a floor-treating unit, and particularly a floor-treating unit of the kind illustrated and described in the aforesaid international patent application, to be manoeuvred readily, and to enable the unit to be transported or rolled over the floor in a simple fashion on two wheels, or to enable the floor treating unit to be manoeuvred and guided when moved over the floor in response to the rotational position of a rod-like device. The invention also enables the rod-like device to be lowered over the unit into a stowing or storage position.

Each of these possibilities is provided through the medium of vertical relative displacement of a first, rod-activating coupling part in relation to a second coupling part belonging to said unit.

BRIEF DESCRIPTION OF THE DRAWINGS

The significant features of an exemplifying embodiment of the present invention at present preferred will now be described with reference to the accompanying drawings, in which FIG. 1*a* is a perspective view of a floor-treating unit of principally the same construction as the unit described and illustrated in the aforesaid international patent application;

FIG. 1*b* is a further perspective view of the unit illustrated in FIG. 1*a;*

FIG. 2 is a perspective view of a coupling means which couples the floor treating unit to the rod-like device which steers said unit, said coupling means being shown in a first locked position, a so-called transport position;

FIG. 3 is a perspective view of the coupling means and shows the means in a second position in which a lock-like arrangement is released such that the second coupling part is able to rotate relative to the unit about a horizontal axle;

FIG. 4 shows in perspective a third position of adjustment in which the rod-like device is lowered over the unit in a stowing or storage position;

DESCRIPTION OF EMBODIMENTS AT PRESENT PREFERRED

Figure 8:
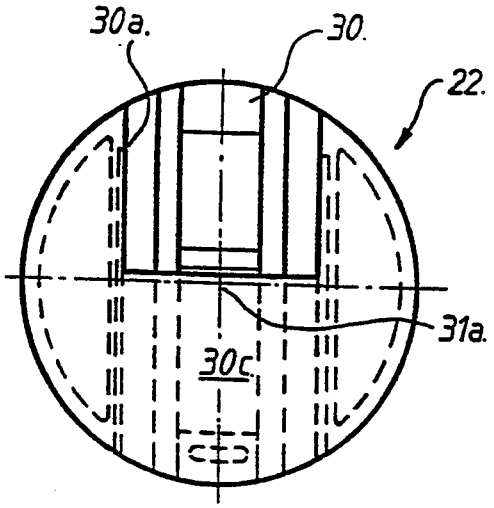
FIGS. 8, 9, 10 are different projection views of a second coupling part or guide housing of said coupling means.

FIG. 1 is a perspective view of a floor-treating unit of principly the same construction as the unit described and illustrated in the aforesaid international patent application. The floor treating unit will not therefore be described in detail here.

For the sake of simplicity, those components which have counterpart in the aforesaid International Patent Application No. PCT/SE90/00133 have been identified by the same reference signs as those used in said application, and the international patent application is considered to form part of this application.

It will be understood that the inventive coupling means is not restricted solely to use with a floor-treating unit of the kind illustrated in FIGS. 1*a* and 1*b*. It will also be understood that the illustrated and described unit merely constitutes an exemplifying embodiment of the inventive unit.

FIG. 2 is a perspective view of a floor-treating unit 1 and a rod-like device 70 which is coupled to the unit 1 by means of a coupling means 20 and which functions to steer or guide said unit. The illustrated coupling means 20 includes a first coupling part 21 which forms part of the rod-like device 70 and a second coupling part 22 which forms part of the unit 1.

The second coupling part 22 is rotatably mounted on the unit 1 and, when in the position illustrated in FIGS. 1*a* and 1*b*, is rotated either clockwise or anti-clockwise, according to the position to which the rod-like device 70 is tilted, thereby to enable the unit 1 to be guided over the floor surface 2 when said unit is moved over the floor for the purpose of treating the same.

The second coupling part 22 is mounted for rotation about a horizontal axis 23.

The rod-like device 70 is intended to coact with the first coupling part 21 through the medium of a horizontal hinge means 24, and preferably through the medium of a connecting device not shown.

The first coupling part 21 is displaceably mounted in relation to the second coupling part 22 and is able to take one of several positional setting.

The displacement movement is effective when said movement is directed vertically and is initiated by exerting a pulling force or a pressing force on the rod-like device 70.

In a first, lowermost position, shown in FIG. 2, the second coupling part 22 is locked against rotational movement in relation to the unit 1.

In a second, slightly higher setting, shown in FIG. 3, the lock-like arrangement is released so that the second coupling part 22 can be rotated in relation to the unit 1 by tilting the rod-like device 70 to different positions. As will be seen from the FIG. 2, in the first setting position, the rod-like device 70 extends upwards and enables the unit to be readily transported or moved, by tipping the unit and supporting said unit solely on the wheels 5, 5', wherein the polishing element 4 is raised slightly above the floor surface 2.

In a third setting, shown in FIG. 4, the rod-like device can be lowered down over the unit 1 to a unit stowing or storage position through the medium of a horizontal hinge device 24.

It will be seen from FIGS. 2, 3 and 4 that the third position or setting, the position shown in FIG. 4, is the uppermost position of the first coupling part 21, and FIG. 4 also shows means for latching rotational movement of the second coupling part 22 in relation to the unit 1, with the aid of stop devices 25, 25' mounted on the unit 1 on a respective side of the rod-like device 70.

It follows from this that the first position, shown in FIG. 2, is the lowermost position of the first coupling part 21. This requires locking of the rotational movement of the second coupling part 22 in relation to the unit 1, by positioning the hinge means 24 in a position so far down in the second coupling part 22 that the rod-like device 70 unable to swing away from or towards the unit 1 and such that the rod-like device is positioned in a groove formed in the unit 1 and defined by the stop devices 25.

The rotational axis 23 of the second coupling part 22 extends horizontally, or generally horizontally, in a direction such that the geometric extension of the axis will pass between the two wheels 5, 5' and through or over a polishing element 4 mounted on the unit.

Figure 5:
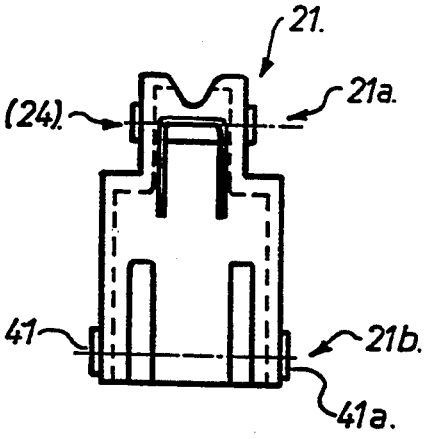
FIGS. 5, 6 and 7 are various projections of a first coupling part or guide slide of said coupling means.
Figure 6:
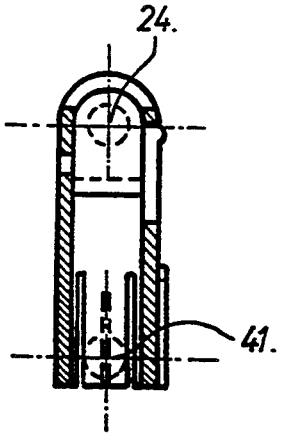
Figure 7:
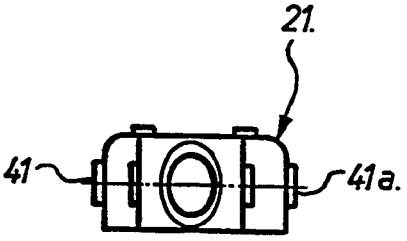

FIGS. 5, 6 and 7 illustrate different projections of the first coupling part 21 of the rod-like device 70. This coupling part 21 has the form of a guide slide and is provided on its upper part 21*a* with means which can form the hinge means 24.

The bottom part 21*b* of the first coupling part is provided with pegs 41, 41*a*.

Figure 9:
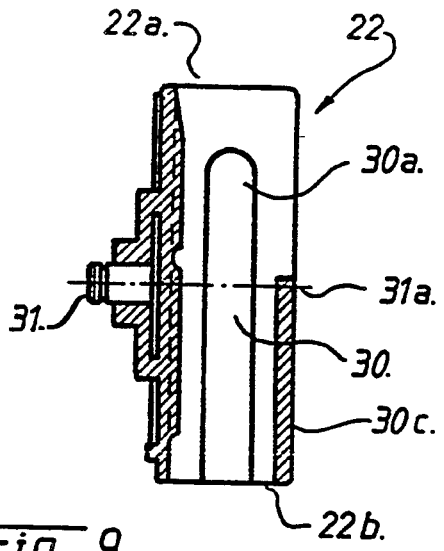
Figure 10:
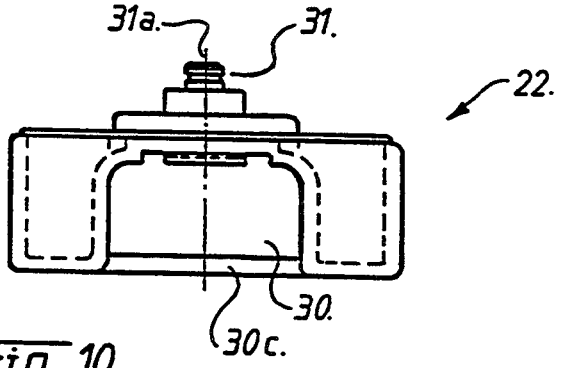

FIGS. 8, 9 and 10 are different projectional views of the second coupling part 22, or guide housing, of the unit 1.

The second coupling part 22 has the form of a channel or hollow tube and is provided at its upper part 22*a* with a channel restriction 30*a*, thereby necessitating insertion of the first coupling part 21 from beneath; in FIG. 9 through the wider channel opening in the lower part 22*b*.

In the uppermost position (FIG. 4), the pegs 41, 41*a* each engage a respective channel restriction 30*a*. The pegs 41, 41*a* are received in and moved along channels 30 provided in the second coupling part 22.

In the intermediate position, the first coupling part 21 is in a position in which the hinge means 24 is located slightly above a centre line 31*a* of a centrally positioned rotational axle 31, and the handle and the rod-like device 70 can be turned to the right and to the left and away from the unit 1.

In the lowermost position, the hinge means 24 shall be located beneath the centre line 31*a* and a cover plate 30*c* locks the hinge means 24 between the rod-like device 70 and the first coupling part 21, so as to position the rod-like device vertically.

Rotational movement of the second coupling part 22 is locked by placing the rod-like device 70 in a groove or slot provided in the unit.

The lowermost position is defined by engagement of the first coupling part 21 with a stop (not shown) which may be provided in the body of the unit.

The restriction 30*a* is upwardly conical, such as to lock the pegs 41, 41*a* against the second coupling part in the uppermost position, by means of a clamping action.

It will be understood that the invention is not restricted to the aforedescribed and illustrated exemplifying embodiment thereof, and that modifications can be made within the scope of the invention as defined in the following Claims.

It will be noted that in the aforesaid second positional setting, the first coupling part 21 will be located in a position in which a hinge means 24 of said part 21, which in the position shown in FIG. 4 is horizontal but which can be rotated around a horizontal rotational axle 23, is positioned perpendicularly in relation to the rotational axle 23. In the position illustrated in FIG. 3, the hinge means 24 is located close to but slightly above the rotational axle 23. This distance may be from 1 to 5 cm.

I claim:

1. In a floor-treating unit having a pair of wheels and a floor-treating element, a coupling device for coupling an elongated rod to the floor-treating unit for allowing the floor-treating unit to be guided, comprising a first coupling part connected to said elongated rod at a hinge axis and a second coupling part rotatably mounted on the floor-treating unit for rotatable movement about a generally horizontal rotational axis which extends between the wheels and over the floor-treating element, the first coupling pan being movably positioned in a slot in the second coupling part for movement between a first positional setting in which said second coupling part is locked against rotational movement, a second positional setting in which the rod is movable about said hinge axis to unlock the second coupling part and permit rotational movement of the second coupling part about the rotational axis, and a third positional setting in which the rod is movable about said hinge axis for being lowered over the floor-treating unit in a stored position.

2. Coupling device according to claim 1, wherein when said first coupling part is located in the first positional setting, the first coupling part is positioned so as to dispose the rod in an upright vertical position relative to said floor-treating unit.

3. Coupling device according to claim 1, wherein said first coupling part is located in an uppermost position within the slot in the second coupling part when the first coupling part is located in said third positional setting.

4. Coupling device according to claim 1, wherein said first coupling part is located in a lowermost position within the slot in the second coupling part when the first coupling part is in the first positional setting, and said second coupling being locked against rotational movement in the first positional setting of the first coupling part through engagement between the rod and a portion of the floor-treating unit.

5. Coupling device according to claim 1, wherein said first coupling part includes oppositely located pegs that engage respective channels in the second coupling part to guide the movement of the first coupling part between the first positional setting, the second positional setting and the third positional setting.

* * * * *